US010020584B2

(12) United States Patent
McGough et al.

(10) Patent No.: US 10,020,584 B2
(45) Date of Patent: Jul. 10, 2018

(54) HOURGLASS-COUPLER FOR WIDE PATTERN-BANDWIDTH SECTOR

(71) Applicant: Cisco Technology, Inc., San Jose, CA (US)

(72) Inventors: Erin Patrick McGough, Akron, OH (US); Thomas Goss Lutman, Berlin Center, OH (US)

(73) Assignee: Cisco Technology, Inc., San Jose, CA (US)

( * ) Notice: Subject to any disclaimer, the term of this patent is extended or adjusted under 35 U.S.C. 154(b) by 255 days.

(21) Appl. No.: 14/807,648

(22) Filed: Jul. 23, 2015

(65) Prior Publication Data

US 2017/0025764 A1 Jan. 26, 2017

(51) Int. Cl.
*H01Q 9/28* (2006.01)

(52) U.S. Cl.
CPC ..... *H01Q 9/285* (2013.01)

(58) Field of Classification Search
CPC ..... H01Q 9/285
See application file for complete search history.

(56) References Cited

U.S. PATENT DOCUMENTS 5,625,367 A 4/1997 Unwin
6,133,889 A 10/2000 Yarsunas et al.
6,243,050 B1 6/2001 Powell
2003/0231138 A1* 12/2003 Weinstein ..... H01Q 1/38 343/795
2009/0079653 A1* 3/2009 Semonov ..... H01Q 1/38 343/793
2012/0075162 A1* 3/2012 Livingston ..... H01Q 1/088 343/884

FOREIGN PATENT DOCUMENTS

WO 2014114932 A1 7/2014

OTHER PUBLICATIONS

Ebrahimi, "A Reconfigurable Narrowband Antenna Integrated with Wideband Monopole for Cognitive Radio Applications", IEEE, 2009.*
International Search Report for Application No. PCT/US2016/043681 dated Oct. 5, 2016.

* cited by examiner

*Primary Examiner* — Dameon E Levi
*Assistant Examiner* — David Lotter
(74) *Attorney, Agent, or Firm* — Patterson + Sheridan, LLP

(57) ABSTRACT

Embodiments disclosed herein generally relate to a dipole antenna having an hourglass shaped coupler. The antenna generally includes two conductive layers, each having a first portion and a second portion of conductive material. The first portion may be connected to a first trace in the first layer, and a width of the first portion flares out from a connection point to the first trace in a first direction. The second portion may be electrically isolated from the first trace and a width of the second portion flares out from a location closest to the first portion in a second direction. In certain embodiments, the second direction is opposite the first direction.

20 Claims, 8 Drawing Sheets

HOURGLASS-COUPLER FOR WIDE PATTERN-BANDWIDTH SECTOR

TECHNICAL FIELD

Embodiments presented herein generally relate to an antenna, and more specifically, a feed structure of a dipole antenna.

BACKGROUND

To provide wireless connectivity and communication between devices in a wireless network, antennas may be used to efficiently radiate (transmit) or receive desired signals to and from other elements of the network. A dipole antenna is one class of antenna that is widely used for signal transmission. In general, it is important to design a printed dipole antenna with a high impedance bandwidth. Parasitic elements may be used to obtain a sector-type radiation pattern for the dipole antenna.

BRIEF DESCRIPTION OF THE DRAWINGS

So that the manner in which the above-recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DESCRIPTION OF EXAMPLE EMBODIMENTS

Overview

Figure 1:
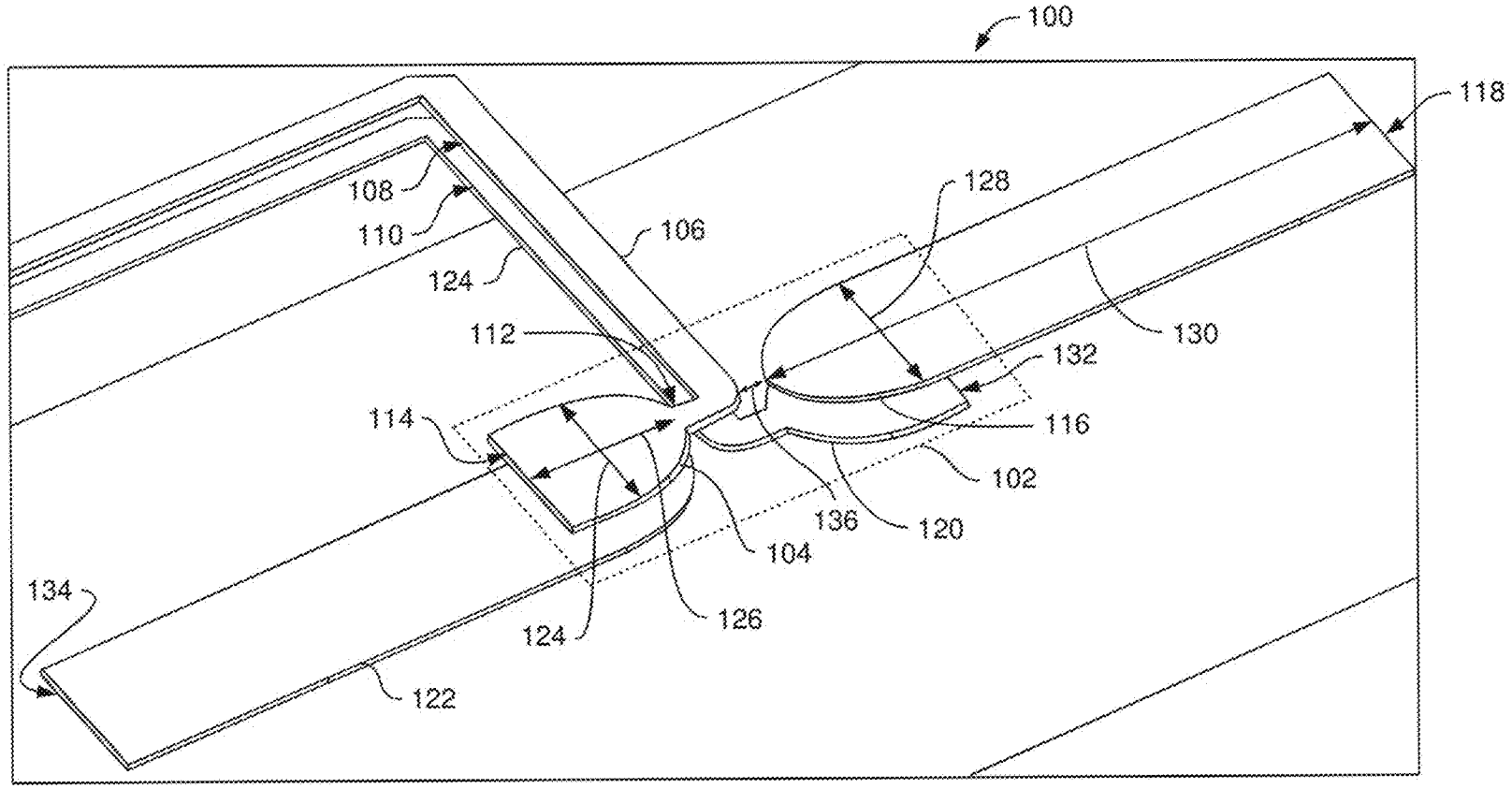
FIG. 1 illustrates a dipole antenna including an hourglass shaped coupler, according to certain embodiments of the present disclosure.

One embodiment presented in this disclosure is a dipole antenna. The dipole antenna generally includes a first conductive layer including a first portion and a second portion, wherein the first portion is connected to a first trace in the first layer, a width of the first portion flares out from a connection point to the first trace in a first direction, the second portion is electrically isolated from the first trace and a width of the second portion flares out from a location closest to the first portion in a second direction, and where the second direction is opposite the first direction. The dipole antenna may also include a second conductive layer, including a third portion and a fourth portion, wherein the third portion is connected to a second trace in the second layer, a width of the third portion flares out from a connection point to the second trace in the second direction, the fourth portion is electrically isolated from the second trace and a width of the fourth portion flares out from a location closest to the third portion in the first direction, and the first and second layers are separated by an insulator.

Another embodiment presented herein is an apparatus for wireless communication. The apparatus generally includes a transmitter configured to provide a modulating signal to a dipole antenna for signal transmission via a first trace, wherein a reference potential for the modulating signal is coupled to a second trace, and wherein the dipole antenna comprises: a first conductive layer comprising a first portion and a second portion, wherein: the first portion is connected to the first trace in the first layer, a width of the first portion flares out from a connection point to the first trace in a first direction, the second portion is electrically isolated from the first trace and a width of the second portion flares out from a location closest to the first portion in a second direction, wherein the second direction is opposite the first direction; and a second conductive layer, comprising a third portion and a fourth portion, wherein: the third portion is connected to the second trace in the second layer, a width of the third portion flares out from a connection point to the second trace in the second direction, the fourth portion is electrically isolated from the second trace and a width of the fourth portion flares out from a location closest to the third portion in the first direction, and the first and second layers are separated by an insulator.

Another embodiment presented herein is a dipole antenna. The dipole antenna generally includes a first conductive layer comprising a first portion and a second portion, wherein: the first portion is connected to a trace comprising conductive material disposed on the first layer, a width of the first portion flares out from a connection point to the trace in a first direction, the second portion is electrically isolated from the trace and a width of the second portion flares out from a location closest to the first portion in a second direction, wherein the second direction is opposite the first direction; and a second conductive layer comprising conductive material forming a mirror image of the trace, the first portion, and the second portion on the first layer.

Example Embodiments

In general, a printed dipole antenna may be designed to achieve a high impedance bandwidth. The impedance of an antenna is a measure of the antenna's current consumption with reference to a voltage of a signal applied to the antenna for signal transmission which changes with frequency. Thus, the impedance bandwidth refers to the range of frequencies over which the antenna can properly radiate or receive energy based on the impedance of the antenna.

A dipole antenna may include at least one parasitic element, which may be used to shape the radiation pattern of the dipole antenna. That is, the parasitic element may be used to obtain a sector-type radiation pattern. However, including the parasitic element to obtain the sector-type radiation pattern may result in a reduction of the impedance bandwidth of the antenna. Moreover, the parasitic elements may increase H-plane pattern variation over the operating spectrum of the antenna.

These unwelcome consequences of pattern shaping at a single frequency (e.g., center frequency) are exacerbated as the operating frequency of the antenna moves away from the center frequency. This may be due to different signal feeding approaches such as the use of narrow-band baluns and couplers, or an unbalanced feed. These feeding approaches either have less impedance bandwidth than the radiating element of the dipole antenna itself or yield undesirable field interactions between the element and the transmission line which result in a modified current distribution on the dipole and pattern distortion.

Embodiments of the present disclosure provide a feeding technique via an hour glass shaped coupler that produces the proper dipole mode over a broad frequency range. Certain embodiments of the present disclosure may be implemented in the design of a wide-beam sector having about 160 degrees of H-Plane beamwidth. The resulting element may have an impedance bandwidth greater than 40% (including a 1.4 to 1 Voltage Standing Wave Ratio (VSWR) over the 5 GHz wireless local area network (WLAN) band) and 2 GHz of radiation pattern bandwidth.

FIG. 1 illustrates a dipole antenna 100 having an hourglass shaped coupler 102, in accordance with certain embodiments of the present disclosure. In one embodiment, the hourglass coupler 102 effectively behaves as a variable capacitor to cancel out the dipole antenna's input reactance, as will be described in more detail herein. As illustrated, the dipole antenna 100 includes a first conductive layer 108 and second conductive layer 110 which each include an hourglass shaped coupler 102. For example, the first layer 108 includes a first portion 104 of conductive material that is connected to a trace 106 at a connection point 112. At this connection point 112, a width of the first portion 104 of conductive material may be the same as the width of the trace 106. However, the width of the first portion 104 of conductive material flares out in a direction extending away from the connection point 112. That is, the width of the first portion 104 increases in a direction towards an end point 114 of the first portion 104.

In certain embodiments, the length 126 of the first portion 104 may range from one eighth to one twentieth of a wave length (λ) (e.g., the operating wave length of a modulating signal used to drive the dipole antenna 100). In certain embodiments, the width of the first portion 104 increases towards the end point 114 up to a maximum width 124, and the width 124 may be maintained along the remaining length. For example, the width 124 of the first portion 104 may increase (or flare) for the first one to three sixteenths of an inch along its length 126 but then remains constant for the remaining length 126. In certain embodiments, the maximum width 124 may range from three to six percent of λ.

The dipole antenna 100 also comprises a second portion 116 of conductive material that is electrically floating (e.g., is electrically isolated from the trace 106 and the first portion 104). The width of the second portion 116 flares out in a similar fashion as the first portion 104 except in the opposite direction. That is, the width of the second portion 116 increases in a direction towards an end point 118 of the second portion 116, up to a maximum width 128. The flaring of the first and second portions 104, 116 form what is referred to herein as the hour glass shape. In certain embodiments, the second portion 116 may be on the same plane as the first portion 104. As illustrated, a length 130 of the second portion 116 may be longer than a length 126 of the first portion 104. In certain embodiments, the length 130 of the second portion 116 may be about a quarter of λ after accounting for circuit board material. In certain embodiments, the width of the second portion 116 increases towards the end point 118 up to a maximum width 128, and the width 128 may be maintained along the remaining length. For example, the width 128 of the second portion 116 may increase (or flare) for the first one to three sixteenths of an inch along its length 130 but then remains constant for the remaining length 130. In certain embodiments, the maximum width 128 may range from three to six percent of λ.

The second conductive layer 110 of the antenna 100 is separated from the first conductive layer 108 by an insulator. For example, the first layer 108 may be on one side of a substrate (not shown), and the second layer 110 may be disposed on the other side of the substrate. The second conductive layer 110 includes a third portion 120 of conductive material that is formed opposite to the second portion 116. A width of the third portion 120 flares out in a similar (or same) fashion to the second portion 116, but the third portion 120 may have a shorter length (e.g., from a connection point of the third portion 120 to the trace 124 towards an end point 132) than the second portion 116. In one embodiment, the length of third portion 120 on the second layer 110 may be approximately equal to the length of the first portion 104 on the first layer 108. In certain embodiments, the third portion 120 is connected to a second trace 124, which may also be disposed on the second layer 110. As illustrated, the third portion 120 of conductive material on the second layer 110 may be directly opposite to the second portion of conductive material 116 on the first layer 108.

The second layer 110 may also include a fourth portion 122 of conductive material which is electrically floating (e.g., electrically isolated from the trace 124, the third portion of conductive material 120, and the elements (e.g., first and second portions 104, 116) on the first layer 108). The width of the fourth portion 122 may flare out in a similar (or same) manner as the first portion 104 and may be directly opposite the first portion 104. While FIG. 1 illustrates the first, second, third, and fourth portions 104, 116, 120, 122 flaring out in a continuous manner, the width of the first, second, third, and fourth portions 104, 116, 120, 122 may also flare out in a discrete manner (e.g., according to a step function).

In certain aspects, the portions of the conductive materials 104, 116, 120, 122 that flare out may have a semicircle shape. Similar to the first and second portions, the width of the third and fourth portions 120, 122 may increase towards the end points 132, 134, respectively, up to a maximum width (not shown), and the maximum width may be maintained along the remaining length of the third and fourth portions 120, 122.

As illustrated, a length of the fourth portion 122 towards an end point 134 may be longer than the length of the first portion 104 and the third portion 120. In certain embodiments, during operation of the antenna 100, the first trace 106 may be coupled to a modulating signal (e.g., from a frequency synthesizer of a transmitter), and the second trace 124 may be coupled to a reference voltage potential. In certain embodiments, the gap 136 between the first and second portions may be less than 30 mils, or less than 1% of λ.

The hourglass coupler 102 as illustrated in FIG. 1 cancels out the input reactance of a half-wavelength dipole over a wide band. For example, the input impedance of an infinitesimally thin unloaded half-wavelength dipole is approximately 73+j42.5 [Ohms]. The input reactance of the half-wavelength dipole may increase as a function of frequency because the electrical length of the dipole may extend past a half-wavelength. Thus, a distributed element (variable) capacitor may be placed at the dipole terminals to cancel out the dipole's input reactance. The hourglass coupler 102 as illustrated in FIG. 1 effectively behaves as a variable capacitor (e.g., a printed distributed capacitor) to cancel out the dipole's input reactance. Its capacitance increases with frequency because the electrical length of the coupler also increases with frequency (e.g., the electrical surface area of the plates increases with frequency). The width of the dipole and the shape of the coupler 102 may determine the operating bandwidth of the element (e.g., dipole antenna 100). By curving the coupler and widening the element (e.g., flaring out a width of the first, second, third, and fourth portions 104, 116, 120, 122), large impedance bandwidths may be achievable.

Figure 2A:
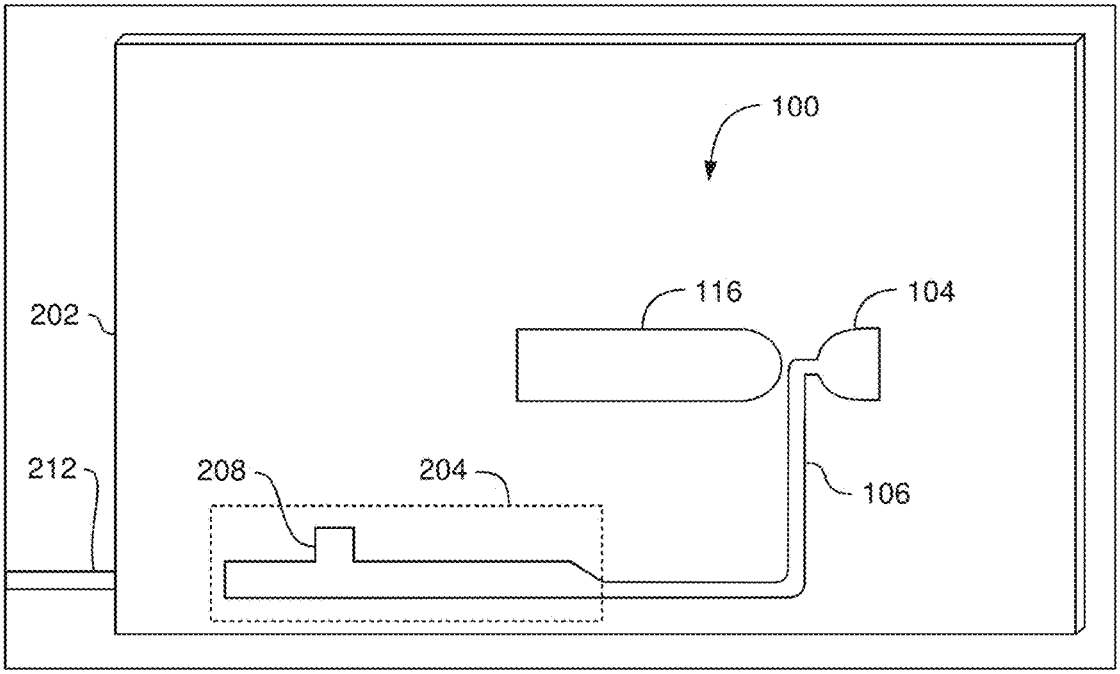
FIGS. 2A and 2B illustrate a front view and back view of a substrate having a dipole antenna with an hourglass shaped coupler, according to certain embodiments of the present disclosure.

FIG. 2A illustrates the first layer 108 of antenna 100 of FIG. 1 on an insulative substrate 202, in accordance with certain embodiments of the present disclosure. As illustrated, the trace 106 is on the first layer 108. The trace 106 is connected to the first portion of conductive material 104 at one end, and to an impedance matching portion 204 at the other end. That is, the impedance matching portion 204 may be configured to match an input resistance of the antenna 100 by adjusting dimensions of the conductive material (e.g., a resistive element) in the impedance matching portion 204. The impedance matching portion 204 also includes a shunt stub 208 used to match a reactance of the antenna 100. To do so, the reactive properties of the stub 208 may be adjusted by, for example, adjusting the stub's physical length in relation to the wavelength of signal transmission using antenna 100. As illustrated, the impedance matching portion 206 may be made of conductive material on the first layer 108.

Figure 2B:
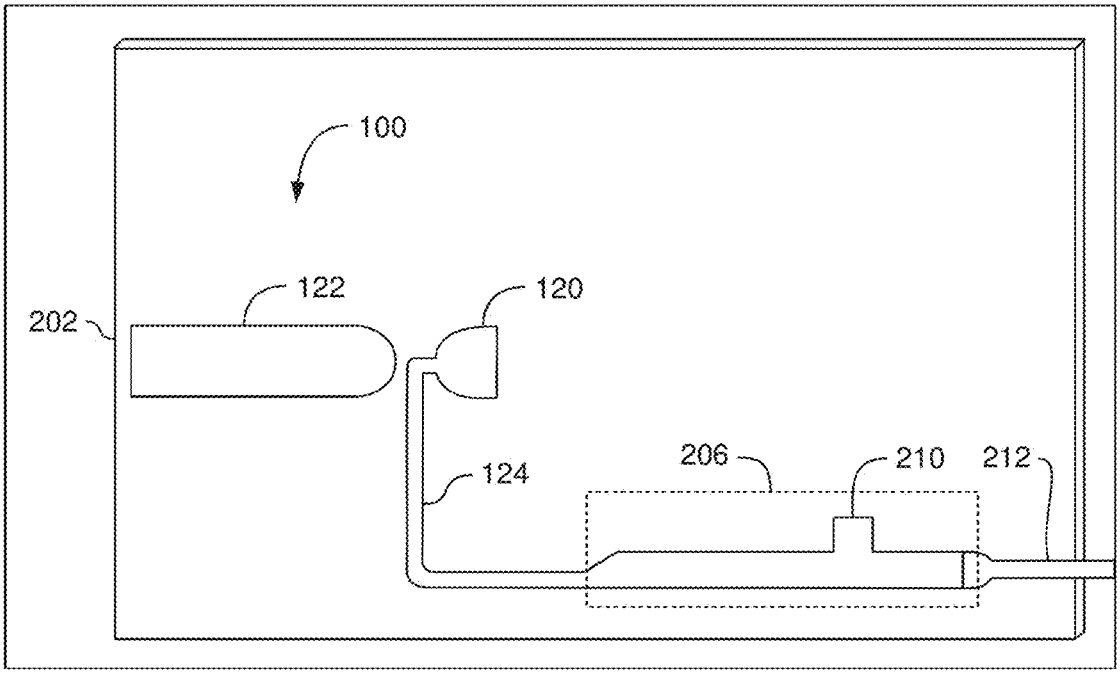

FIG. 2B illustrates the second layer 110 of antenna 100 of FIG. 1 on a substrate 202, in accordance with certain embodiments of the present disclosure. As illustrated, the second layer 110 includes the third portion of conductive material 120 and the fourth portion of conductive material 122. The third portion 120 is coupled to the trace 124 which is coupled to another impedance matching portion 206. Similar to impedance matching portion 204 of FIG. 2A on the first layer 108, the impedance matching portion 206 is used for matching the input impedance of the antenna 100, and may have a shunt stub 210. As illustrated, the impedance matching portion 206 may be made of conductive material on the first layer 108.

The first trace 106 may be coupled with a modulating signal (e.g., modulating signal on a coax cable 212) through the impedance matching portion 204 and the second trace 124 may be coupled with a reference voltage potential (e.g., reference voltage potential of the coax cable 212) through the impedance matching portion 206. As illustrated, the reference voltage potential of the coax cable 212 may be coupled with the impedance matching portion 204 through the substrate 202.

Figure 3:
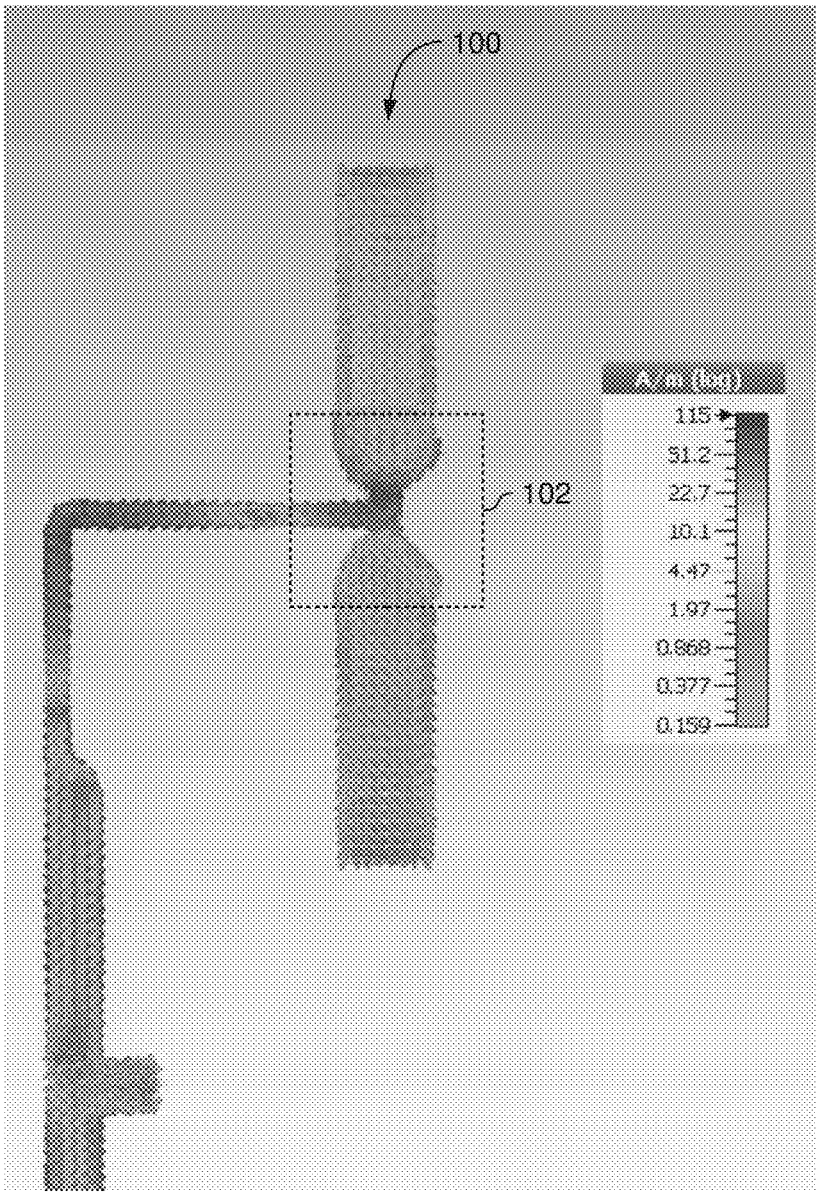
FIG. 3 illustrates the current distribution of the dipole antenna of FIG. 1, according to certain embodiments of the present disclosure.

FIG. 3 illustrates the current distribution of the antenna 100, in accordance with certain embodiments of the present disclosure. The antenna 100 including the hourglass coupler 102 shapes the current at the feed point to produce the proper current distribution over a wide band, resulting in improved radiation pattern bandwidth. The current on each coupling section contains a strong axial vector component. At a specific design frequency (e.g., 5.5 GHz), the series impedance of one of the coupling sections may be small (1/jwC), which may improve capacitive coupling. The high electric field in the gap between the poles of the antenna 100 (e.g., gap between the first and fourth portions 104, 122, and the second and third portions 116, 120) and the current shaping accomplished by the coupler yield improved axial current distribution at the design frequency. The number of possible current paths may be increased by widening the dipole and shaping the coupler 102. Near the lower end of an operating frequency range (e.g., 4-7 GHz) the series impedance of the coupler 102 increases, forcing the current to the outer edge of the coupler 102. This effectively extends the current path with little modification to the current distribution or the input impedance.

Figure 4:
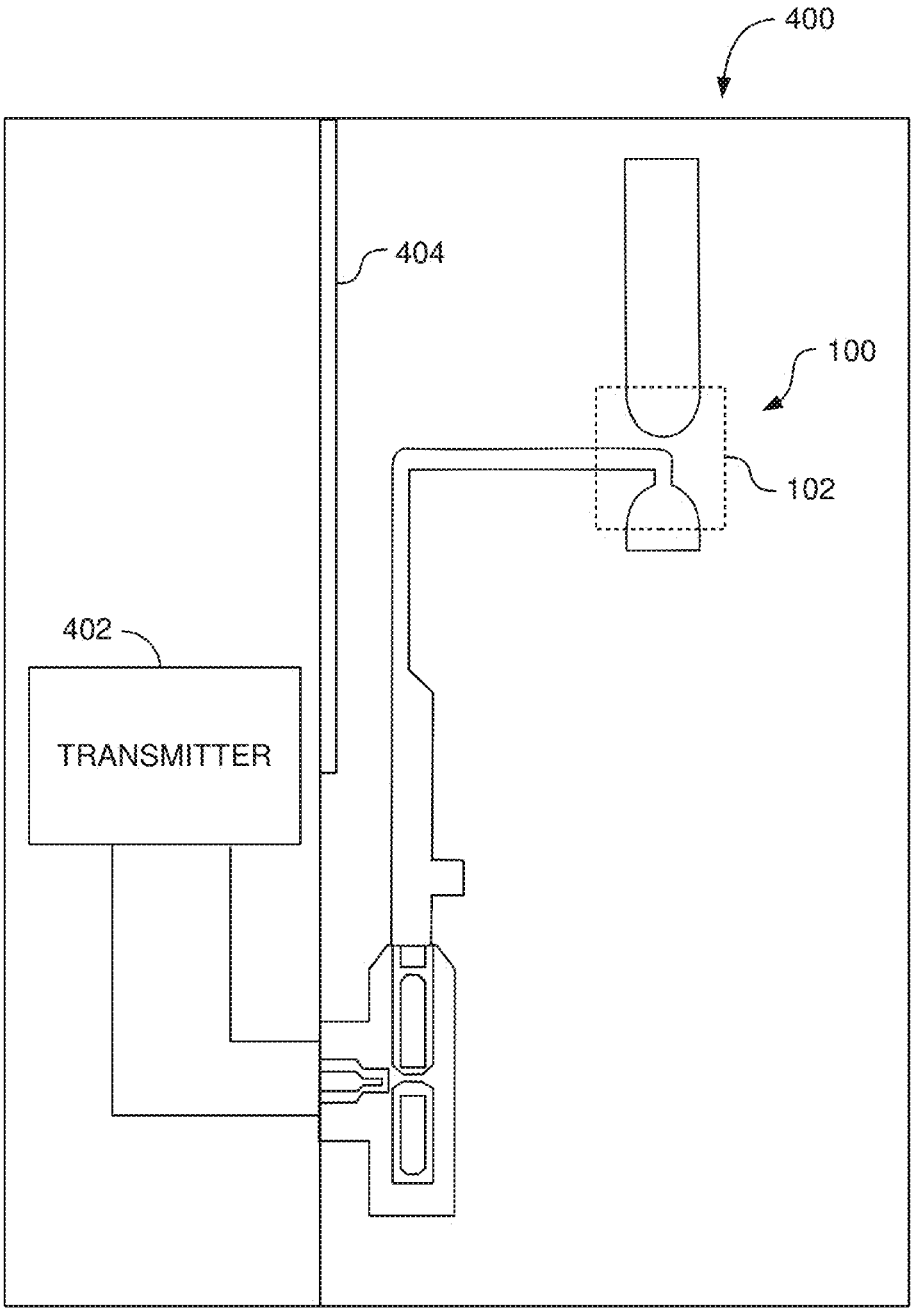
FIG. 4 illustrates a system having a transceiver to transmit and receive signals via a dipole antenna having an hourglass shaped coupler, according to certain embodiments of the present disclosure.

FIG. 4 illustrates a system 400 including a transmitter 402 configured to drive the antenna 100 of FIG. 1 for signal transmission, in accordance with certain embodiments of the present disclosure. In certain embodiments, the system 400 may include a receiver (not shown) for signal reception using antenna 100. The antenna 100 may be spaced a free-space quarter wavelength from a parasitic reflector 404, used to shape the radiation pattern of the antenna 100. Thus, the design of the antenna 100 may first account for the loading effect of the substrate (e.g., using Jaisson's approximation) in order to calculate the length of a half-wavelength dipole at a design frequency (e.g., which may be 4-7 GHz), based on which the location of the parasitic reflector may be determined.

Figure 5:
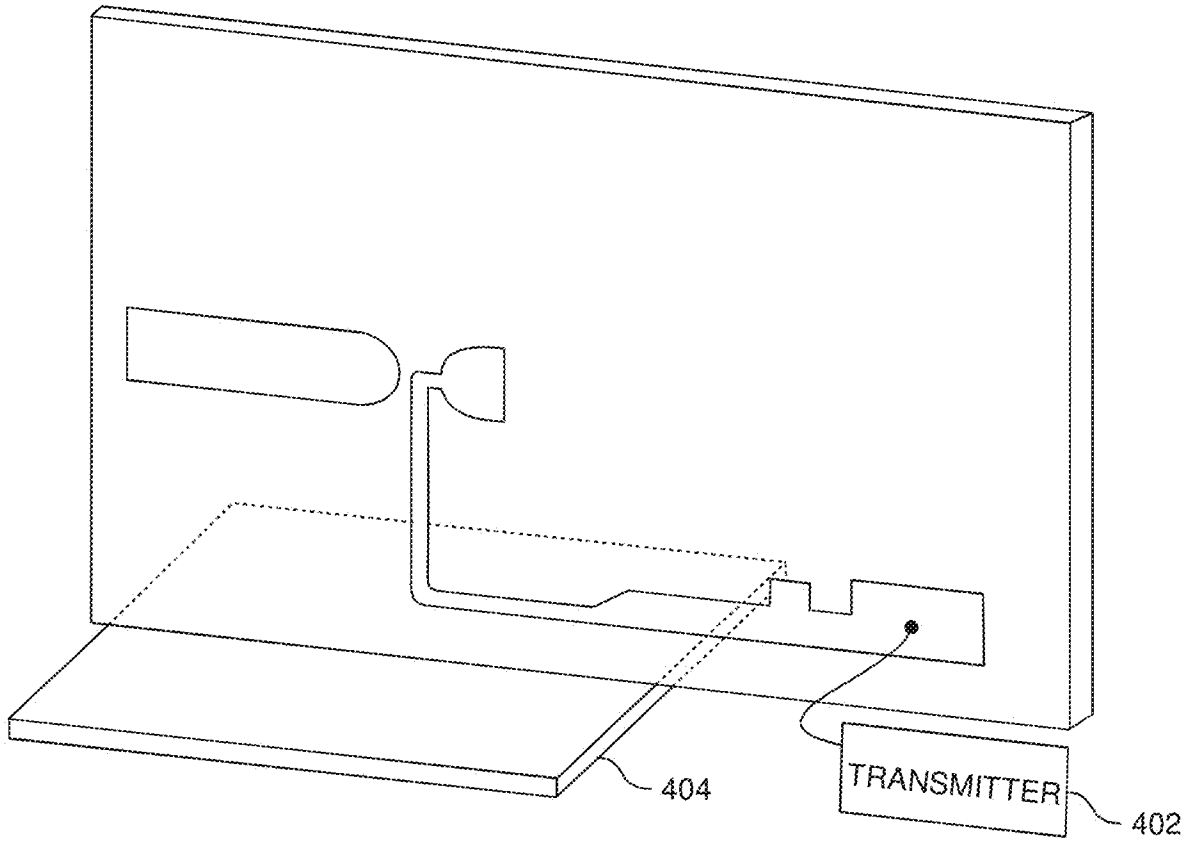
FIG. 5 illustrates a perspective view of the system of FIG. 4, according to certain embodiments of the present disclosure.

FIG. 5 illustrates the system 400 showing a perspective view of the parasitic reflector 404, in accordance with certain embodiments of the present disclosure. The dimensions of the parasitic reflector 404 may be optimized to achieve a specific beamwidth specification. The hourglass coupler 102 is then incorporated, which cancels out the input reactance of a half-wavelength dipole over a wide band and shapes the current at the feed point (e.g., feed point of the hourglass coupler 102) to produce the proper current distribution over the wide band improving radiation pattern bandwidth. Because the input impedance over much of the frequency range may be greater than 50 Ohms and may vary, a single step-up transformer may be used to rotate the input impedance. For example, the transmitter 402 may include the step-up transformer to step up the voltage of a signal for transmission using the antenna 100. At least one open shunt stub (e.g., stubs 208 and 210) may then be used to complete the impedance match. Although not required, it may be desirable to have the step-up transformer because the paired strip line used to provide the impedance transformation may be physically smaller than its 50 Ohm counterpart, which facilitates the transition to the coupler 102 and helps mitigate feed line effects.

Figure 6:
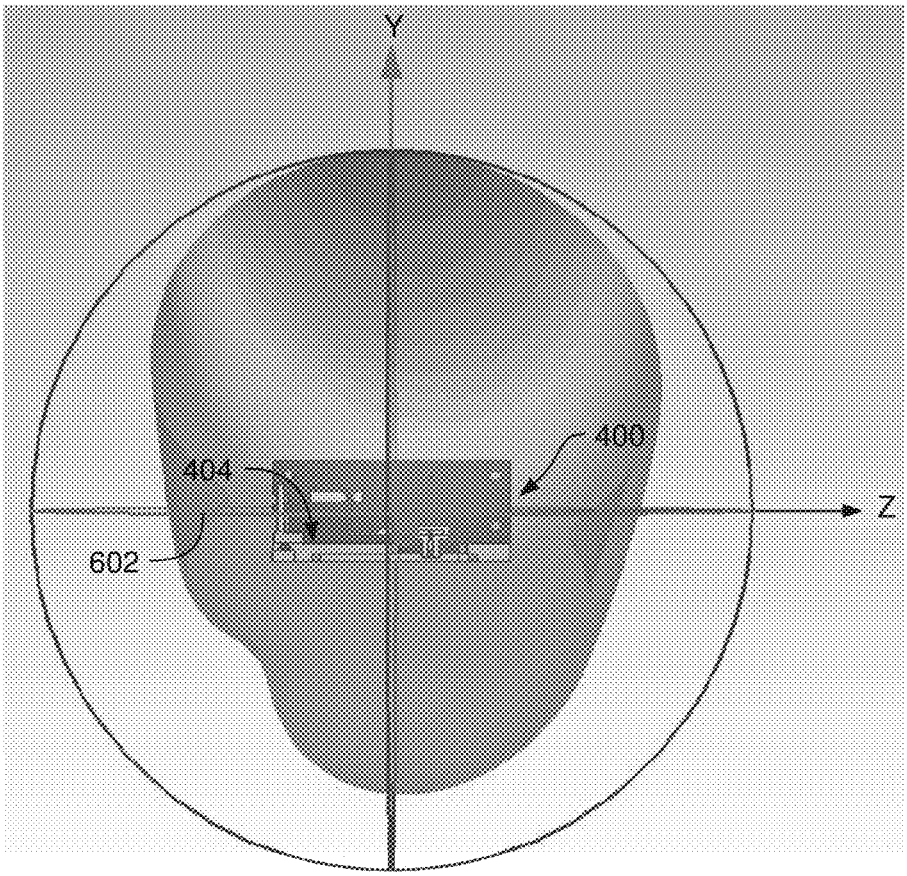
FIG. 6 illustrates the elevation radiation pattern of the system of FIG. 4, according to certain embodiments of the present disclosure.

FIG. 6 illustrates the elevation radiation pattern of the system 400 of FIG. 4 as seen from a first side, in accordance with embodiments of the present disclosure. The elevation pattern illustrates the radiation pattern of the system 400 in the y-direction that is perpendicular to a base plane of the parasitic reflector 404. As illustrated, the system 400 with the hourglass coupler 102 and the parasitic reflector 404 has a strong radiation pattern in the positive y-direction relative to the negative y-direction.

Figure 7:
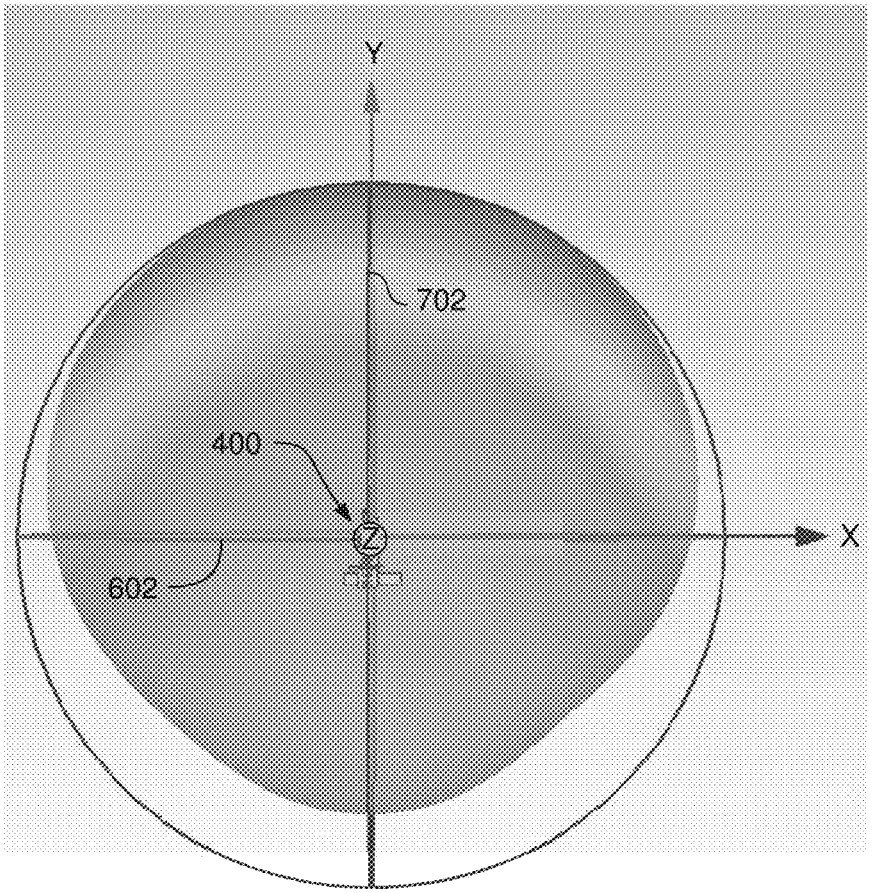
FIG. 7 illustrates the radiation pattern from a first side of the system of FIG. 4 in the azimuth plane, according to certain embodiments of the present disclosure.

FIG. 7 illustrates the azimuth plane radiation pattern of the system 400 of FIG. 4 from another side that is rotated 90 degrees on the plane 602 with reference to FIG. 6, in accordance with certain embodiments of the present disclosure. As illustrated, the system 400 with the hourglass coupler 102 has a strong radiation pattern in the positive y-direction with reference to the negative y-direction. Moreover, the radiation pattern strengths in the positive and negative x directions are about the same.

Figure 8:
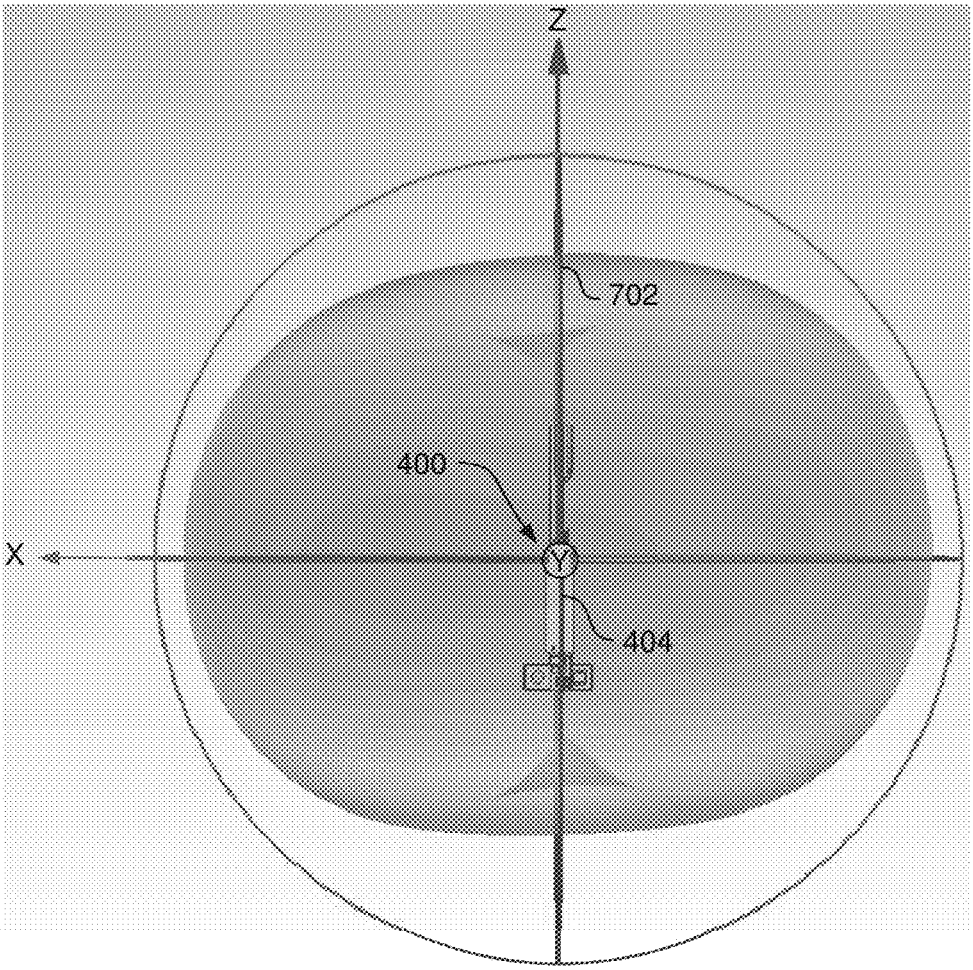
FIG. 8 illustrates the radiation pattern from a second side of the system of FIG. 4 in the azimuth plane, according to certain embodiments of the present disclosure.

FIG. 8 illustrates the azimuth plane radiation pattern of the system 400 of FIG. 4 from a top side that is rotated 90 degrees on the plane 702 with reference to FIG. 7, in accordance with certain embodiments of the present disclosure. As illustrated, the system 400 with the hourglass coupler 102 has about the same radiation pattern strength in the positive and negative x-direction that is parallel to the base plane of the parasitic reflector 404. Similarly, the radiation pattern positive and negative z directions are about the same. However, as illustrated, the radiation pattern in the x direction is stronger than the radiation pattern in the z direction.

In the preceding, reference is made to embodiments presented in this disclosure. However, the scope of the present disclosure is not limited to specific described embodiments. Instead, any combination of the described features and elements, whether related to different embodiments or not, is contemplated to implement and practice contemplated embodiments. Furthermore, although embodiments disclosed herein may achieve advantages over other possible solutions or over the prior art, whether or not a particular advantage is achieved by a given embodiment is not limiting of the scope of the present disclosure. Thus, the preceding aspects, features, embodiments and advantages are merely illustrative and are not considered elements or limitations of the appended claims except where explicitly recited in a claim(s).

The flowchart and block diagrams in the Figures illustrate the architecture, functionality and operation of possible implementations of systems or methods. It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved.

In view of the foregoing, the scope of the present disclosure is determined by the claims that follow.

We claim:

1. A dipole antenna, comprising:

a first conductive layer comprising a first portion and a second portion, wherein:

the first portion is connected to a first trace in the first conductive layer, a width of the first portion flares out from a connection point to the first trace in a first direction, the second portion is electrically isolated from the first trace and a width of the second portion flares out from a location closest to the first portion in a second direction, wherein the second direction is opposite the first direction; and a second conductive layer, comprising a third portion and a fourth portion, wherein:

the third portion is connected to a second trace in the second conductive layer, a width of the third portion flares out from a connection point to the second trace in the second direction, the fourth portion is electrically isolated from the second trace and a width of the fourth portion flares out from a location closest to the third portion in the first direction, and the first and second conductive layers are separated by an insulator.

2. The antenna of claim 1, wherein the first and second conductive layers are parallel layers spaced apart by an insulative substrate.

3. The antenna of claim 2, wherein at least a portion of the first trace that connects to the first portion in the first conductive layer is directly opposite at least a portion of the second trace that connects to the third portion on the second conductive layer.

4. The antenna of claim 1, wherein the first portion of the first conductive layer is directly opposite the fourth portion of the second conductive layer.

5. The antenna of claim 1, wherein the second portion of the first conductive layer is directly opposite the third portion of the second conductive layer.

6. The antenna of claim 1, wherein the second portion has a length extending in the second direction that is greater than a length of the first portion extending in the first direction, and the fourth portion has a length extending in the first direction that is greater than the length of the third portion extending in the second direction.

7. The antenna of claim 6, wherein the length of the first portion is approximately equal to the length of the third portion and the length of the second portion is approximately equal to the length of the fourth portion.

8. The antenna of claim 1, wherein the first trace is coupled to a modulating signal, and the second trace is coupled to a reference voltage potential.

9. The antenna of claim 1, wherein the first and second traces include at least one resistive element configured to match an input resistance of the antenna to a desired resistance.

10. The antenna of claim 1, wherein a capacitance between the first and second portions changes based on an operating frequency of the antenna and a capacitance between the third and fourth portions changes based on the operating frequency of the antenna.

11. The antenna of claim 10, wherein the capacitance between the first and second portions and the capacitance between the third and fourth portions increase as the operating frequency increases.

12. The antenna of claim 1, wherein at least a portion of the first portion has a semicircle shape, and at least a portion of the second portion has a semicircle shape.

13. The antenna of claim 1, wherein the first and second portions have an hourglass shape and the third and fourth portions have an hourglass shape.

14. An apparatus for wireless communication, comprising:

a transmitter configured to provide a modulating signal to a dipole antenna for signal transmission via a first trace, wherein a reference potential for the modulating signal is coupled to a second trace, and wherein the dipole antenna comprises:

a first conductive layer comprising a first portion and a second portion, wherein:

the first portion is connected to the first trace in the first conductive layer, a width of the first portion flares out from a connection point to the first trace in a first direction, the second portion is electrically isolated from the first trace and a width of the second portion flares out from a location closest to the first portion in a second direction, wherein the second direction is opposite the first direction; and a second conductive layer, comprising a third portion and a fourth portion, wherein:

the third portion is connected to the second trace in the second conductive layer, a width of the third portion flares out from a connection point to the second trace in the second direction, the fourth portion is electrically isolated from the second trace and a width of the fourth portion flares out from a location closest to the third portion in the first direction, and the first and second conductive layers are separated by an insulator.

15. The apparatus of claim 14, wherein the first and second conductive layers are parallel layers spaced apart by an insulative substrate.

16. The apparatus of claim 15, wherein at least a portion of the first trace that connects to the first portion in the first conductive layer is directly opposite at least a portion of the second trace that connects to the third portion on the second conductive layer.

17. The apparatus of claim 14, wherein the first portion of the first conductive layer is directly opposite the fourth portion of the second conductive layer.

18. The apparatus of claim 14, wherein the second portion of the first conductive layer is directly opposite the third portion of the second conductive layer.

19. The apparatus of claim 14, wherein the second portion has a length extending in the second direction that is greater than a length of the first portion extending in the first direction, and the fourth portion has a length extending in the first direction that is greater than the length of the third portion extending in the second direction.

20. A dipole antenna, comprising:

a first conductive layer comprising a first portion and a second portion, wherein:

the first portion is connected to a trace comprising conductive material disposed on the first conductive layer, a width of the first portion flares out from a connection point to the trace in a first direction, the second portion is electrically isolated from the trace and a width of the second portion flares out from a location closest to the first portion in a second direction, wherein the second direction is opposite the first direction; and a second conductive layer comprising conductive material forming a mirror image of the trace, the first portion, and the second portion on the first conductive layer.

* * * * *